United States Patent [19]

Straw et al.

[11] Patent Number: 4,825,589

[45] Date of Patent: May 2, 1989

[54] HANGING PLANT CARRIER

[76] Inventors: Jesse H. Straw, R.R. 3, Box 331,, Tyrone, Pa. 16686; David L. Straw, 9916 Cherry La., Silver Spring, Md. 20901

[21] Appl. No.: 23,235

[22] Filed: Mar. 9, 1987

[51] Int. Cl.[4] ..... A01G 9/02

[52] U.S. Cl. ..... 47/67; 242/107.12

[58] Field of Search ..... 47/67, 39; 242/107, 242/107.4 R, 107.5, 107.6, 107.12; 248/329, 330.1, 330

[56] References Cited

U.S. PATENT DOCUMENTS

| | | | |
|---|---|---|---|
| 4,051,627 | 10/1977 | Schilling, Jr. | 47/39 |
| 4,152,829 | 5/1979 | Kaupp | 47/39 |
| 4,187,996 | 12/1980 | Ehrlich | 47/67 |
| 4,190,212 | 2/1980 | Cochia | 242/107 |
| 4,470,558 | 9/1984 | Stamper | 242/107.6 |
| 4,556,184 | 12/1985 | O'Sullivan | 47/67 |
| 4,669,693 | 6/1987 | Kagan | 47/67 |

FOREIGN PATENT DOCUMENTS

| | | | |
|---|---|---|---|
| 1282132 | 1/1961 | France | 67/67 |
| 2132172 | 5/1984 | United Kingdom | 47/67 |

*Primary Examiner*—Richard J. Johnson

*Assistant Examiner*—Lynda M. Cofsky

[57] ABSTRACT

A useful device in combination with a conventional type hanging plant support for quickly and easily lowering a potted plant from its uppermost hanging position for servicing and returning. The device provides a surface on which a potted plant is placed and embodies a spring powered reel below the supporting surface with three cables of suitable strength partially wound thereon extending out of and equally spaced about its perimeter to form part of the total support, thus providing means of lengthening the support as the reel unwinds and thereby lowering the plant for attention. Associated with the reel is a locking device or latch so that the suspended plant may be locked into any desired position within its total vertical movement. The assembly and locking device can be grasped and actuated at a point centrally below the support so that rectilinear vertical movement to any desired elevation is readily achieved and maintained without tilting, disturbing, or spilling the contents of the supported pot. The axis of the reel is arranged for adjustment of the spring tension to counterbalance the variable weight of the compatible pots and potting materials, also for optimum ease of displacement throughtout its total movement.

6 Claims, 3 Drawing Sheets

Sec. View 6-6

Sec. View 5-5

Sec. View 7-7

HANGING PLANT CARRIER

This invention relates to a convenient means for supporting and vertically positioning hanging plants and the like.

BACKGROUND OF THE INVENTION

It is desirable to be able to vertically position hanging plants for best display and to be able to conveniently raise and lower such plants for servicing.

An example of one type of plant elevator which has been proposed is disclosed in U.S. Pat. No. 4,187,996. In this disclosure a device, attached through a keyhole opening to an anchor in a ceiling or the like, includes a single cord on a spring roller and a latch. The single cord extends downward and the latch is released or reengaged by a horizontal movement of the supported article, which moves the cord to other than a vertical position.

SUMMARY OF THE INVENTION

Through the present invention an assembly is provided for hanging and supporting a plant or the like in conveniently adjusted vertical positions for display and/or servicing, accessible from below and involving only vertical rectilinear movement in positioning for maximum stability and minimum disturbance of the supported plant, and including features for attractiveness, reliable operation, and economical adjustment and manufacture. The above features and advantages of the invention and other features and advantages will be apparent from the following description, the accompanying drawings, and the appended claims.

THE DRAWINGS

DESCRIPTION OF A PREFERRED EMBODIMENT

Figure 1:
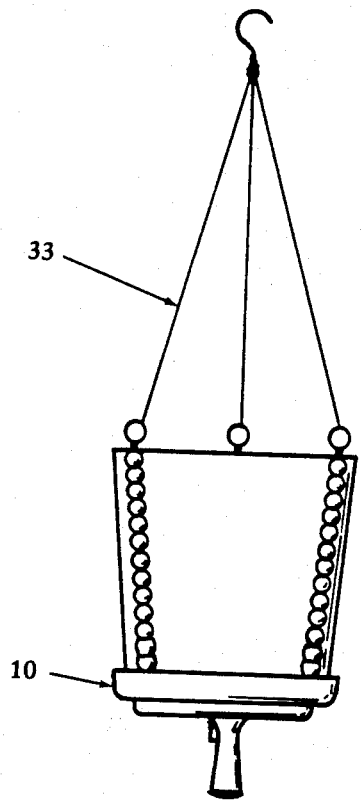
FIG. 1 is a view representing a hanging potted plant in its uppermost display position.
Figure 2:
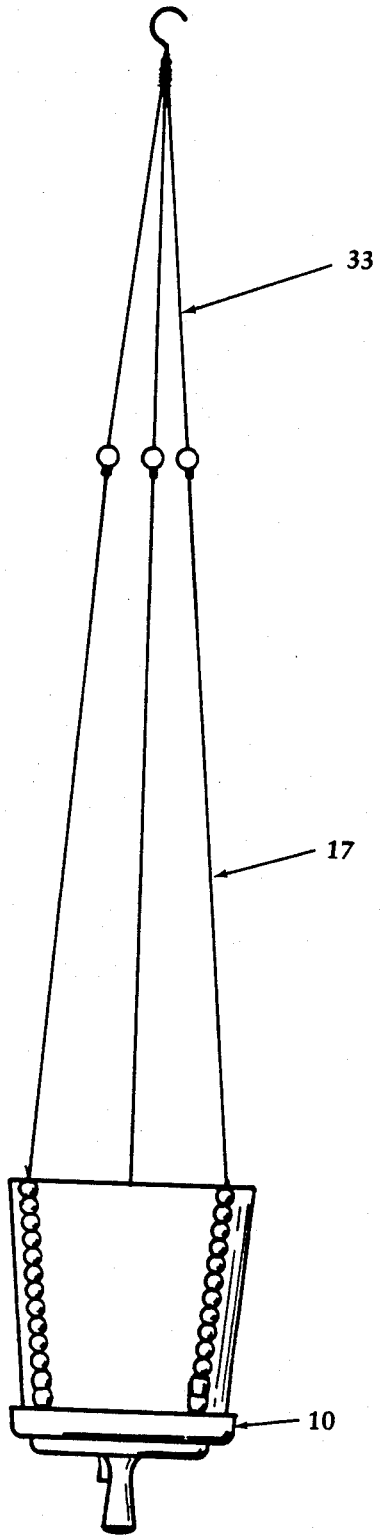
FIG. 2 represents the same hanging plant retracted to a position of service.

Referring in more specific detail to the accompanying drawings, the assembly comprises a housing 10 consisting of two housing members 11 and 12 which may be formed from, among other materials, a suitable grade of injection molded synthetic resinous material. These members 11 and 12 are securely fastened together with rust resistant screws 13. Each of these members 11 and 12 are so molded that in assembly a cavity will be formed as shown to confine a reel 14 and related mechanism, namely a latch 15, a coil spring 16, and suspension cables 17 attached to and partially wound thereon.

A stem 18 of the reel housing unit assembles through a hole cast into housing member 12 and is attached to handle 19. The reel 14 comprises two members 20 and

Figure 3:
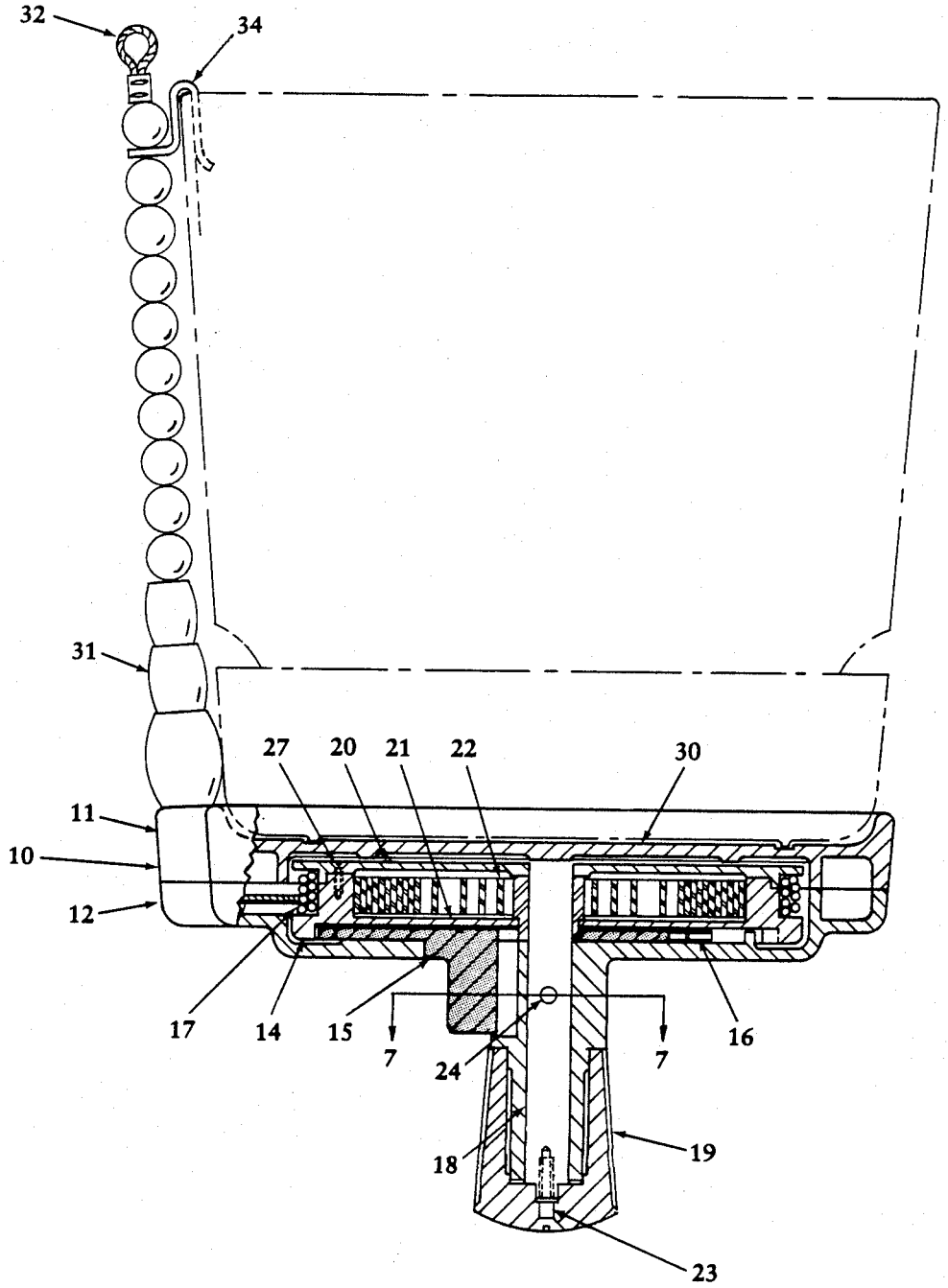
FIG. 3 is a partial sectional view of one embodiment, showing the reel and related mechanism.

21 which may also be constructed from a suitable grade of injection molded synthetic resinous material. It is formed to create a cavity at assembly to house motor spring 22, as illustrated particularly in FIG. 3. Handle or grip 19 is fitted onto the milled end of stem 18 to effect a key so that by turning handle 19, with locking pin 24 temporarily removed, power spring 22 may be adjusted as required for a full or partially counterbalance of the suspended items.

Lower member 21 of reel 14 is formed to provide notches 25 of suitable configuration around its diameter into which a projection 26 on latch 15, urged by spring 16 will fit, thus releasably locking reel 14 against rotation. The reel members 20 and 21 are attached by conventional screw fasteners 27. Handle 19 and latch 15 are relatively positioned so that the same hand which grips handle 19 for rectilinear vertical movement can readily actuate latch 15.

Figure 6:
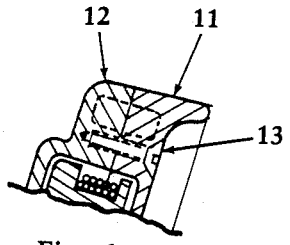
FIG. 6 is a fragmentary view of the fastening means of the embodiment members, at plane 6—6 of FIG. 4.
Figure 5:
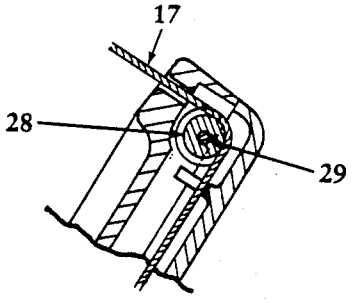
FIG. 5 is a fragmentary view of the cable guiding means, at plane 5—5 of FIG. 4.
Figure 4:
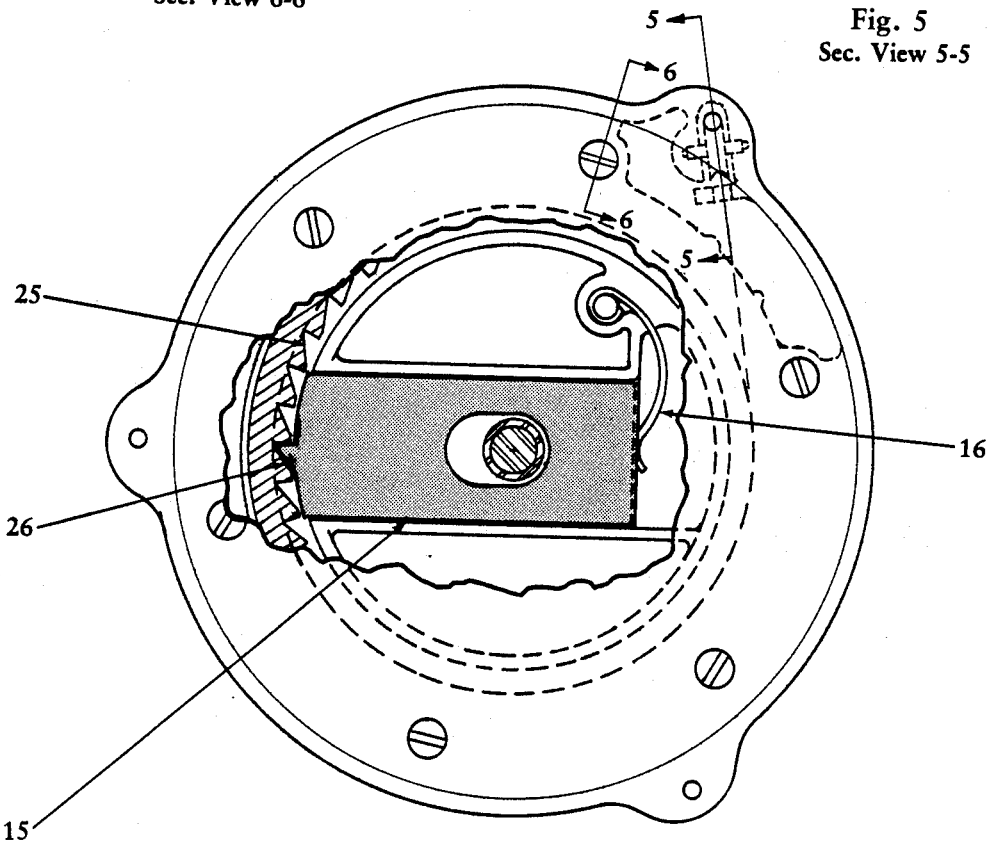
FIG. 4 is a plan view, particularly showing the spring urged locking mechanism.
Figure 7:
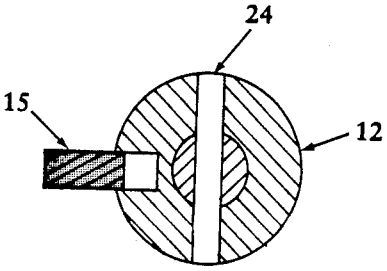
FIG. 7 is a sectional view taken on plane 7—7 of FIG. 3, showing the retaining pin inserted.

Housing 10, at three places equally spaced about its circumference, provides pockets into which rotatable grooved rollers 28 are housed. See, in particular, FIGS. 4, 5, and 6. Such pockets are so shaped that the axis pins 29 will fit tightly while the rollers 28 are free to rotate, thus guiding cables 17 from horizontal to vertical directions.

Housing member 11 is formed to provide a suitable support area 30 on which a potted plant is placed.

Cables 17 protruding from housing 10 are decorated with a selection of shapes and colors of bead-like ornaments 31, common in the art of macrame. These provide a decorative cover and sleeve-like bearing for the cables. Each cable 17 is constructed with a loop at its upper end into which a hanging plant support 33 is attached.

Clamp 34, which holds cables 17 in their approximate functional position, also holds the cable and ornaments 31 on housing 10 for handling until installation. Clamp 34 also prevents endwise movement of ornaments 31 as the cables pass through them.

The hanging plant retractor is preferably shipped complete with a pot and preadjusted for the spring counter-balance needed when filled and planted.

While the assembly herein described constitutes a preferred embodiment of the invention, it is to be understood that the invention is not limited to this precise construction, and that changes may be made therein without departing from the scope and spirit of the invention as defined in the appended claims.

The invention having thus been described, the following is claimed:

1. In an assembly for use in supporting and vertically positioning a plant suspended from above, the improvement comprising, a base support for carrying a plant on an upper surface thereof, a reel included in said support below the plant supporting upper surface thereof rotatable therein about a vertical axis, plural cable suspension means wound about said reel, at least three of said cable means passing from said reel in a generally vertical direction, said cable means being equally spaced about said base support to pass alongside a plant and container carried by said support, means for fixedly suspending the upper ends of said cables at points above said plant and container, means rotatably urging said reel to wind in one direction and retract said cable means thereabout, a manual grip at the lower part of said support below said reel including a manually operated latch cooperating between said support and said reel for actuating said latch to release said reel for manual vertical positioning of said support through said grip during relative vertical movement of said cables alongside said plant and its container and to engage said latch to prevent rotation of said reel for locking said support in the selected vertical position.

2. An assembly as set forth in claim 1 wherein said manual grip comprises a projection centrally downward below said support for easy gripping from below and a manually operated trigger associated therewith for simultaneously actuating said latch with the same hand.

3. An assembly as set forth in claim 1 wherein said means urging said reel in one direction comprises a spring coiled about the vertical axis of said reel acting to substantially counterbalance said support and a plant carried thereby for easy rectilinear positioning.

4. An assembly as set forth in claim 3, further comprising a control stem rotatable about a vertical axis within said support, means fixing the outer end of said spring to said support and the inner end to said stem, the lower end of said stem projecting below said support and being connected to said grip for rotation to vary the spring tension and adjust the counterbalancing effect, and further means for fixing said stem and grips against rotation relative to said support in the adjusted position.

5. An assembly as set forth in claim 1 wherein said cable suspension guide includes rotatable guiding means directing each respective cable means from a direction tangential to said reel to a substantially vertical direction for smooth, friction - free movement of said support.

6. An assembly as set forth in claim 1 including decorative means concentric about each of said cable means and through which each respective cable means passes with freedom, and restraining means restricting said decorative means against rectilinear movement relative to said support and a container carried thereby upon vertical relative movement of said cable means therethrough during vertical positioning of said support and container.

* * * * *